US008887760B2

(12) United States Patent
Elliott

(10) Patent No.: US 8,887,760 B2
(45) Date of Patent: Nov. 18, 2014

(54) SYSTEM FOR DELIVERING FRAC WATER AT HIGH PRESSURE

(75) Inventor: David J. Elliott, Dawson Creek (CA)

(73) Assignee: Flo-Dynamics, Inc., Dawson Creek, British Columbia (CA)

( * ) Notice: Subject to any disclaimer, the term of this patent is extended or adjusted under 35 U.S.C. 154(b) by 299 days.

(21) Appl. No.: 13/356,539

(22) Filed: Jan. 23, 2012

(65) Prior Publication Data

US 2013/0061963 A1 Mar. 14, 2013

(30) Foreign Application Priority Data

Oct. 14, 2011 (CA) ..... 2756167

(51) Int. Cl.

| | |
|---|---|
| ***F04D 13/16*** | (2006.01) |
| ***F04D 13/12*** | (2006.01) |
| ***F04B 23/02*** | (2006.01) |
| ***E21B 43/26*** | (2006.01) |

(52) U.S. Cl.

CPC ..... *E21B 43/26* (2013.01)
USPC ... 137/565.3; 137/571; 137/575; 137/565.31; 417/205; 417/244

(58) Field of Classification Search

USPC ..... 137/565.3, 565.31, 571, 575; 417/205, 417/244

See application file for complete search history.

(56) References Cited

U.S. PATENT DOCUMENTS

| | | | | |
|---|---|---|---|---|
| 3,362,588 | A * | 1/1968 | Jeep, Jr. et al. | 222/385 |
| 4,301,007 | A * | 11/1981 | Savard et al. | 210/96.1 |
| 2011/0206497 | A1* | 8/2011 | Pasquesi et al. | 415/121.2 |
| 2013/0028760 | A1* | 1/2013 | Lin | 417/410.1 |

* cited by examiner

*Primary Examiner* — Craig Schneider
*Assistant Examiner* — Atif Chaudry
(74) *Attorney, Agent, or Firm* — LeClairRyan, a Professional Corporation

(57) ABSTRACT

A system for delivering frac water at high pressure is provided, including a first pump positionable within a tank, the first pump configured to receive water from within the tank and output the water at pressure to a first pressure tank; a second pump positionable above the first pressure tank, the second pump configured to receive water from the first pressure tank and output the water at pressure to a second pressure tank; and a third pump positionable above the second pressure tank, the third pump configured to receive water from the second pressure tank and output pressurized water to a discharge piping, the discharge piping leading said pressurized water over a wall of said tank.

8 Claims, 3 Drawing Sheets

SYSTEM FOR DELIVERING FRAC WATER AT HIGH PRESSURE

STATEMENT OF RELATED APPLICATION

The present application claims the benefit of priority under 35 U.S.C. 119(b) to Canadian Patent Application Serial No. 2756167 filed Sep. 14, 2011, in the name of inventor David J. Elliot, entitled "System for Delivering Frac Water at High Pressure", all commonly owned herewith.

FIELD OF THE INVENTION

This invention relates to the use of water in shale gas wells, and more particularly to the delivery of frac water at high pressure for use in such wells.

BACKGROUND

In shale gas wells, water is used to carry a propping agent, such as sand, under pressure, into a wellbore. The pressure causes the rock to 'fracture', and thereby release the trapped gas. These fractures are held open by the propping agent. The water for this purpose is stored in lined open top tanks and is extracted from the tank at high volumes, up to 18 $m^3$/min. The open top tank should be leak proof, which is accomplished through the use of geomembrane liners. If the liner becomes damaged, the tank becomes at risk of developing a leak. The liner is typically either a one piece liner that is positioned inside the tank, covering the floor and the walls of the tank, or is several rolls of liner that are welded together to form a seal. The liner covers the floor and walls of the tank to form a watertight layer, independent of the tank structure.

Prior art pumping methods from lined open top tanks include:

- a suction intake positioned at the bottom of the tank (usually at a bell hole), which is then piped under the wall of the tank and exits to the surface at the exterior of the tank wall. As a hole being cut in the liner; the intake extrusion is welded to the liner with a gasket;
- a suction intake running through the wall of the tank, wherein a hole is cut in the liner and the tank wall, and the hole and piping are patch welded to create a seal;
- a suction pipe that runs up over the wall of the tank, without penetrating it; wherein the water is "sucked" through the pipe by a centrifugal pump located outside the tank; and
- an extremely heavy pumping structure placed directly onto the geomembrane liner on the tank floor.

For example a common pump solution is to use suction piping through the wall or floor of the tank, feeding centrifugal pumps. This system is undesirable because it involves cutting a hole in the leak-proof layer, and then re-sealing it. Also, the pumps are less robust than submersible pumps, and there is often no redundancy in case of pump failure which puts the water transfer at risk (and therefore the well completion).

Another system currently available uses a single 10" suction pipe that extends up alongside the wall of the tank and feeds a centrifugal pump(s). This system provides little redundancy and is risky if a pump or power failure occurs. Also, output from centrifugal pump may not be consistent depending on the depth of water in the tank.

Yet another pump solution uses submersible pumps and an extremely heavy stair system. This system includes built in stairs that run over the wall of the tank. In this solution a number of submersible pumps are used that cavitate when in use as the pump intakes compete for available water. The bulk of the weight of the stairs is placed on the liner at the floor of the tank. The problem with this is that the pumps put a great deal of stress and pressure on the liner. The system is also extremely large, and not portable, requiring special trailers for highway transportation and large cranes for positioning. The size also poses a safety risk for workers potentially falling into the tank.

The problem with the prior art methods is that the geomembrane liner integrity is compromised, and the tank is therefore at risk of leaking. Also, the pump systems used often do not meet the flow rates required, as well as the total dynamic head (TDH) required (the TDH can be translated into required pump pressures).

In order to reach the required TDH of the system, previous methods have used a booster pump to increase the pumping pressure. These booster pumps are typically centrifugal pumps (diesel or electric) placed outside the water storage tank.

Placing the booster pump outside the storage tank increases the risk of environmental damage in case of pump failure (a spill). In general, an exterior booster pump is fragile and susceptible to pipe stress, which may lead to material fatigue and failure.

SUMMARY OF THE INVENTION

A system for delivering frac water at high pressure is provided, including a first pump positionable within a tank, the first pump configured to receive water from within the tank and output the water at pressure to a first pressure tank; a second pump positionable above the first pressure tank, the second pump configured to receive water from the first pressure tank and output the water at pressure to a second pressure tank; and a third pump positionable above the second pressure tank, the third pump configured to receive water from the second pressure tank and output pressurized water to a discharge piping, the discharge piping leading said pressurized water over a wall of said tank.

DESCRIPTION OF THE INVENTION

Figure 2:
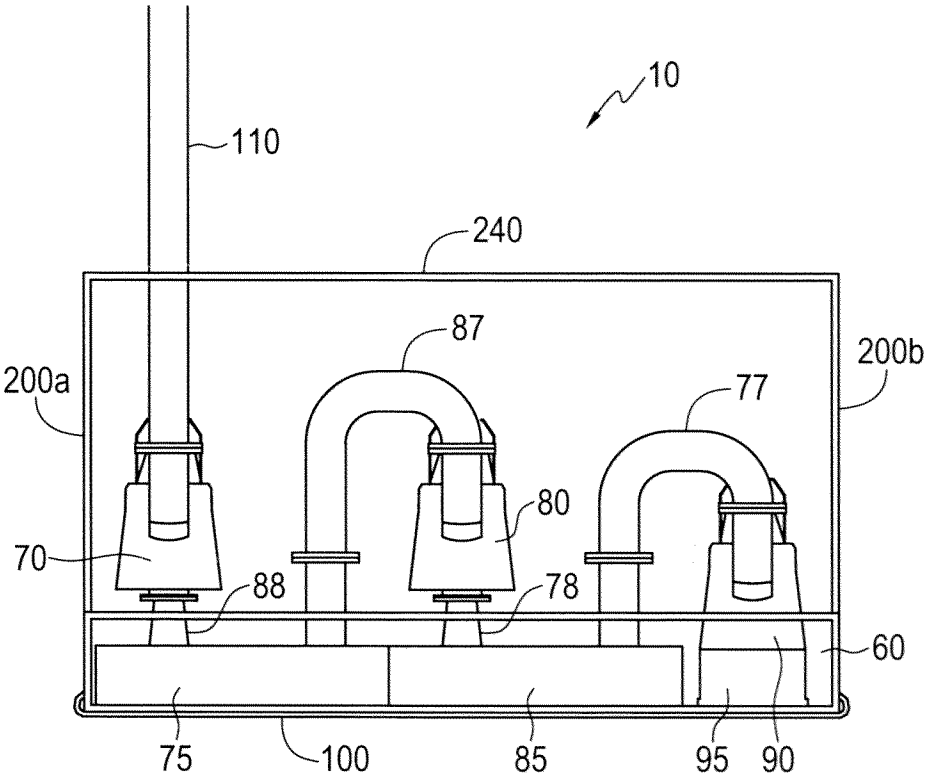
FIG. 2 is a front view of an alternative embodiment thereof.

As seen in FIGS. 1 through 4, the system 10 uses pumps 70, 80, 90 to pump water from a tank 20, which may be a c-ring, at high pressure (such as 125 psi or more), while maintaining the integrity of the geomembrane lining 30 on the floor 40 and wall 50 of tank 20. The geomembrane lining 30 prevents tank 20 from leaking. Pumps 70, 80, 90 are located within tank 20 to eliminate the risk of spill in case of pump failure. If a pump fails, water will be contained within the tank.

System 10 includes a pump support 60 which supports a number of submersible water pumps, such as primary pump 90, and booster pumps 70, 80. Support 60 includes base 100 which may be a flat steel plate and should provide for a safety factor of at least two compared to the yield strength of the lining 30, as listed in the product engineering data from the supplier. Base 100 has a 1" thick foam padded layer on the bottom to act as the contact layer between the lining 30 and the base 100.

Stabilizer bars 200*a*, 200*b* each extend upwardly at about a 30 to 70 degree angle from the corners of base 100 closest to tank wall 50 towards pumps 70, 80, 90. Stabilizer bars 200*a*, 200*b* meet vertical bars 220*a*, 220*b*, respectively, at horizontal bars 230*a*, 230*b*. The two horizontal bars 230*a*, 230*b* are connected by support bar 240, which is sized to rest against and support piping 110. Vertical bars 220*a*, 220*b*, extend upwardly from the top of support structure 60, and may be supported by a plurality of short bars 250. Other arrangements of bars to add support to piping 20 may be substituted. Support structure 50 may be made of concrete, although bars 200, 220, 230, 240, and 250 may be made of concrete or a metal such as steel.

Pump support 60 may include compartments (not shown) to isolate the pumps, with dividing walls positioned between pumps.

Figure 1:
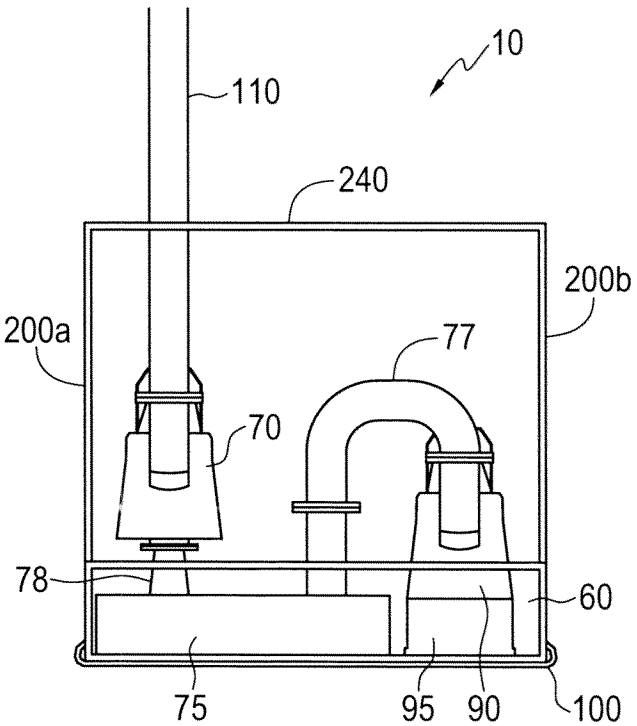
FIG. 1 is a front view of the system according to the invention.
Figure 3:
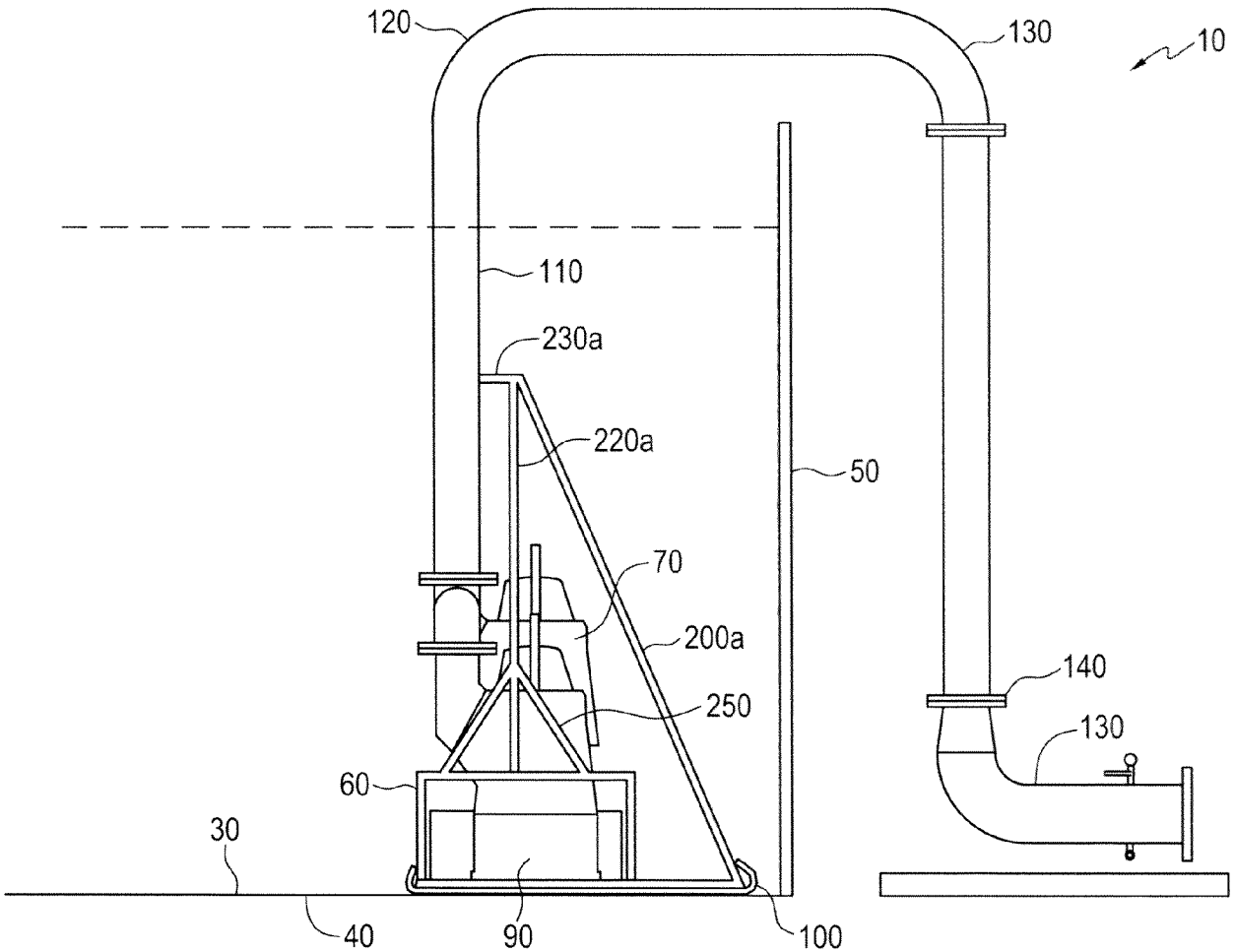
FIG. 3 is a side view thereof, showing the system positioned within a tank.
Figure 4:
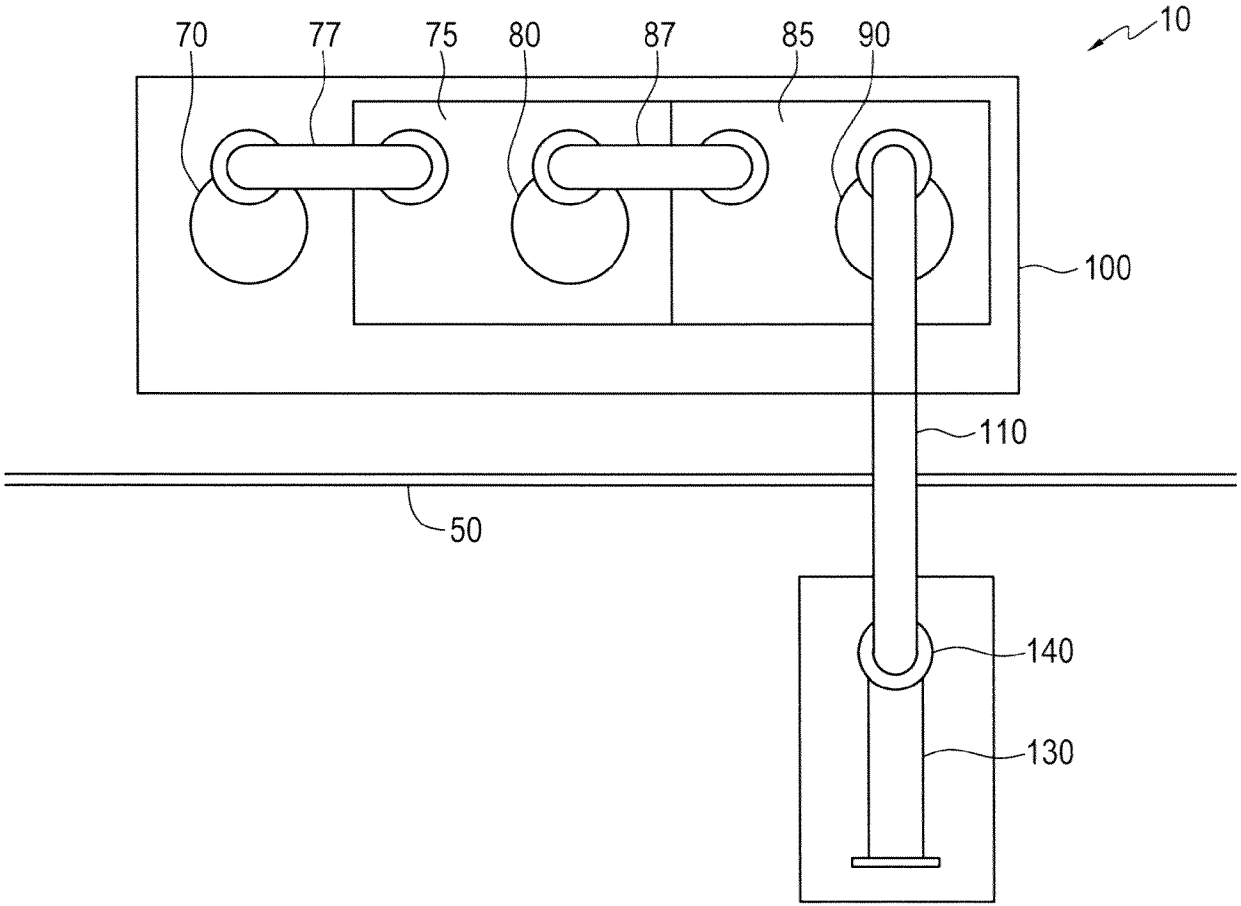
FIG. 4 is a top view thereof.

FIG. 1 displays a two pump in series configuration, and FIG. 2 displays a three pump in series configuration. Pressure tanks 75, 85 (just 75 in FIG. 1) and pipes 77, 87 (just 77 in FIG. 1) separate and connect booster pump 70, booster pump 80 and primary pump 90 in series (pump 80 is excluded from the configuration shown in FIG. 1). Pressure tanks 75, 85 allow primary pump 90 to feed a second booster pump 70, or primary pump 90 to feed booster pump 80 which then feeds a second booster pump 70. Pipes 78, 88 feed from the top of pressure tanks 75, 85 directly to the intake of booster pumps 70, 80. Pumps 70, 80 and 90 are supported on their bases in a stable position, and support 60 provides a low center of gravity. Pump 90 is positioned on a filter 95 to allow water from that tank to reach pump 90.

Additional pumps can be added in parallel to produce more output volume. Additional pumps can also be added in series to increase the output pressure.

Booster pumps 70, 80 are elevated as water is fed directly into their inlet, or pump suction, from the pressure tank 75, 85 positioned below, which contains water from the pump before it. Only the primary pump 90 is positioned lower, and has a suction screen and is pumping water directly from tank 20. Booster pumps 70, 80 do not pump 'new' water from tank 20, instead they boost (the pressure of) the water that is pumped from the preceding pump.

Discharging piping 110 may be steel or HDPE piping sized to match the discharge diameter of the pumps, and is hard mounted to support 60. Piping 110 extends vertically above the height of tank wall 50. Elbow 120 turns pipeline 110 horizontally, and then another elbow 130 turns pipeline 110 downwards. Connecting conduit 130 is connected to flange 140 at the end of pipeline 110 and runs to a manifold (not shown) positioned exterior to tank 20. Conduit 130 may be a pressure rated rubber hose, pressure rated HDPE, or steel piping.

Pipeline 110 and pump support 60 may be lifted and placed into the tank as one unit. Conduit 130 may be attached prior to placement into tank 20 for safety thereby avoiding connecting conduit 130 to flange 140 while working at heights.

Manifold 150 accepts the pump discharge from conduit 130, and is designed to be connected to additional discharge piping should pumps be arranged in parallel, and then transfers the water away from tank 20 to its destination. A parallel pump configuration allows for flow variability, and for pumps to be isolated or added quickly.

System 10 is implemented by placing submersible pumps 70, 80, 90 inside open top tank 20, and discharging the water in tank 20 up and over the wall of the tank into manifold 150. Contact with the liner is minimized, and any such contact protected to prevent liner 30 damage occurring. Discharge piping 110 can include steel pipes, rubber hose or HDPE. Solid steel piping provides an accessible and secure lifting point for system 10 placing and retrieval, regardless of tank water levels.

System 10 is lightweight, highly portable, installs in short amount of time, protects tank liner 30, provides high flow rates and high pressure, and has built in pump redundancy with the presence of multiple pumps if the pumps are configured in parallel.

System 10 is modular and more pumps can be added in parallel for more flow, or alternately more pumps can be added in series for higher pressure. In addition, desired system pressure can be achieved with all pumps being contained within the tank greatly minimizing the risk to the environment, avoiding additional secondary containment, and avoiding additional equipment placed elsewhere. This means that the end user can be confident of their water delivery, and can focus on the frac process without worrying about water supplies or servicing remote booster stations scattered along the pipeline route.

The system described herein has other uses as well as delivering frac water at high pressure, and can be generally used in situations where water needs to be drained from a tank under such pressure.

The above-described embodiments have been provided as examples, for clarity in understanding the invention. A person with skill in the art will recognize that alterations, modifications and variations may be effected to the embodiments described above while remaining within the scope of the invention as defined by claims appended hereto.

What is claimed is:

1. A system for delivering frac water at high pressure, comprising:

a first pump, said first pump positioned within a tank above a filter, said first pump configured to intake water from within said tank;

a first pressure tank positioned horizontally adjacent to said filter and below said first pump to receive water from said first pump;

a second pump, said second pump positioned within said tank above said first pressure tank and horizontally adjacent said first pump, said second pump configured to receive pressurized water from said first pressure tank;

wherein the second pump is in fluid communication with discharge piping, said discharge piping leading over the wall of said tank.

2. The system of claim 1 wherein a pipe connects said second pump to said first pressure tank.

3. The system of claim 2 wherein said first and second pumps are positioned within a support structure.

4. A system for delivering frac water at high pressure, comprising:

a first pump positioned within a tank above a filter, said first pump configured to receive water from within said tank and output said water at pressure to a first pressure tank positioned horizontally adjacent to said filter and below said first pump;

a second pump positioned within said tank above said first pressure tank and horizontally adjacent said first pump, and configured to receive water from said first pressure tank and output water at pressure to a second pressure tank positioned horizontally adjacent to said first pressure tank;

a third pump positioned within said tank above said second pressure tank and horizontally adjacent said second pump, and configured to receive water from said second pressure tank and output pressurized water to a discharge piping, said discharge piping leading said pressurized water over a wall of said tank.

5. The system of claim 4 wherein a first pipe connects said second pump to said first pressure tank.

6. The system of claim 5 wherein a second pipe connects said third pump to said second pressure tank.

7. The system of claim 6 wherein said first, second and third pumps and said first and second pressure tanks are positioned within a support structure.

8. The system of claim 7 wherein said support structure includes a padded base positioned between said filter, said first pressure tank and said second pressure tank and a floor of said tank.

* * * * *